US011292022B2

(12) United States Patent
Quan et al.

(10) Patent No.: US 11,292,022 B2
(45) Date of Patent: Apr. 5, 2022

(54) FLUID FILLING NOZZLE, APPARATUS, AND METHOD OF FILLING A CONTAINER WITH A FLUID

(71) Applicant: The Procter & Gamble Company, Cincinnati, OH (US)

(72) Inventors: Ke-ming Quan, West Chester, OH (US); Eric Shawn Goudy, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 90 days.

(21) Appl. No.: 16/818,643

(22) Filed: Mar. 13, 2020

(65) Prior Publication Data

US 2020/0216207 A1 Jul. 9, 2020

Related U.S. Application Data

(63) Continuation of application No. 15/230,504, filed on Aug. 8, 2016, now abandoned.

(51) Int. Cl.

| | |
|---|---|
| ***B05B 17/06*** | (2006.01) |
| ***B65B 3/36*** | (2006.01) |
| ***B67C 3/28*** | (2006.01) |
| ***B65B 3/12*** | (2006.01) |
| ***B65B 39/00*** | (2006.01) |

(52) U.S. Cl.

CPC ..... *B05B 17/0607* (2013.01); *B05B 17/063* (2013.01); *B65B 3/12* (2013.01); *B65B 3/36* (2013.01); *B65B 39/001* (2013.01); *B67C 3/28* (2013.01); *B65B 2210/08* (2013.01)

(58) Field of Classification Search

CPC . B05B 17/06–0692; B05B 7/144; B65B 3/12; B65B 3/36; B65B 39/001; B65B 2210/08; B67C 3/28; A61M 15/0085

See application file for complete search history.

(56) References Cited

U.S. PATENT DOCUMENTS

| | | | | |
|---|---|---|---|---|
| 4,003,518 | A ‡ | 1/1977 | Hori | F23D 11/10 239/102.2 |
| 4,756,478 | A * | 7/1988 | Endo | B05B 17/0623 239/102.2 |
| 5,104,042 | A * | 4/1992 | McKown | B05B 17/063 239/102.2 |
| 5,105,861 | A | 4/1992 | Berger et al. | |

(Continued)

FOREIGN PATENT DOCUMENTS

| | | |
|---|---|---|
| DE | 1123545 B | 2/1962 |

OTHER PUBLICATIONS

All Office Actions; U.S. Appl. No. 15/230,504.

(Continued)

*Primary Examiner* — Andrew D Stclair
(74) *Attorney, Agent, or Firm* — Gary J. Foose

(57) ABSTRACT

A fluid filling apparatus for filling containers with a fluid is provided. An ultrasonic frequency is used to vibrate a filling nozzle between successive container filling cycles. The vibrations break a liquid string filament formed at a discharge end of the filling nozzle at the end of each filling cycle. Methods and a fluid filling nozzle for filling containers with a fluid are also provided.

18 Claims, 5 Drawing Sheets

(56) References Cited

U.S. PATENT DOCUMENTS 6,102,298 A ‡ 8/2000 Bush ..... A47J 37/044 239/102.2
6,377,387 B1 4/2002 Duthaler et al.
8,658,248 B2 * 2/2014 Anderson ..... B05B 13/0463 427/255.28
2003/0048038 A1 * 3/2003 Tsai ..... B05B 17/063 310/328
2008/0265052 A1 ‡ 10/2008 Quan ..... B05B 17/0623 239/4
2008/0265055 A1 ‡ 10/2008 Quan
2008/0265056 A1 * 10/2008 Quan ..... B05B 17/0669 239/102.2
2011/0037795 A1 * 2/2011 Kojima ..... B05B 17/0607 347/10
2011/0272060 A1 ‡ 11/2011 Clusserath ..... B67C 3/22 141/11
2013/0206857 A1 8/2013 Ivri
2017/0203322 A1 * 7/2017 Ivri ..... B05B 17/0684
2017/0209899 A1 ‡ 7/2017 Hirashita ..... B06B 1/0644
2018/0037351 A1 2/2018 Quan et al.

OTHER PUBLICATIONS

International Search Report and Written Opinion; Application Ser. No. PCT/US2017/042688; dated Oct. 26, 2017, 13 pages.
Sonics & Materials Inc. catalogue, "Vibra-cell™ High Intensity Liquid Processors", published Jan. 2015, 31 pgs.
Sonics & Materials Inc., "Ultrasonic Atomizers", 3 pgs.
Lonzaga et al., "Liquid jet response to internal modulated ultrasonic radiation pressure and stimulated drop production", The Journal of the Acoustical Society of America, vol. 121, Issue 6, pp. 3323-3330, Jun. 2007.
Lonzaga et al., "Uniformly valid solution for acoustic propagation in weakly tapered circular waveguides: Liquid jet example", vol. 124, Issue 1, pp. 151-160, Jul. 2008.

* cited by examiner
‡ imported from a related application

FLUID FILLING NOZZLE, APPARATUS, AND METHOD OF FILLING A CONTAINER WITH A FLUID

TECHNICAL FIELD

The present disclosure provides for technologies for filling a container with a fluid. In particular, the present disclosure relates to a fluid filling nozzle, an apparatus, and a method that utilizes ultrasonic vibration to break liquid string filaments extending from the fluid filling nozzle between doses.

BACKGROUND

High speed container filling systems are well known and used in many different industries. In many of the systems, fluids are supplied to containers to be filled through a series of pumps, pressurized tanks and flow meters, fluid filling nozzles, and/or valves to help ensure the correct amount of fluid is dispensed into the containers. At the end of a filling cycle, or between successive filling cycles, however, conventional pumps, pressurized or gravity fed systems, filling nozzles, and valves may cause a fluid string filament to be created that extends between the tip of the fluid filling nozzle and the container being filled. The length of the string filament and the time to breakup under gravity depend on fluid (viscosity, visco-elastic properties), the nozzle geometry and the surrounding media (e.g. relative humidity or partial pressure of solvent). Stringing is found to be common in filling consumer products such as liquid detergent, skin cream, shampoo and conditioner. In order prevent the fluid from being exposed to the environment, from splashing on the filling equipment and the outside of the container, and/or, in the case of unit dose packages, from contaminating the sealing region of the container being filled, the fluid string filament must be broken prior to commencement of the next filling cycle. Typically, this liquid string filament is broken via a suck-back mechanism, displacement of the fluid filling nozzle, and/or gravity. In such applications, the total time to fill each container is lengthened. Accordingly, it would be desirable to provide an improved fluid filling system, and especially a fluid filling nozzle, that reduces the amount of time required to break liquid string filaments at the end of or between successive filling cycles.

SUMMARY

In one embodiment, the present disclosure is directed to a fluid filling nozzle for filling a container. The fluid filling nozzle may be any suitable type of nozzle. In some cases, the fluid filling nozzle may be an ultrasonic nozzle that is configured to dispense fluid in the form of a stream. The fluid filling nozzle includes a longitudinal centerline and a body having a discharge end and an orifice at the discharge end. The fluid filling nozzle is constructed to receive a flow of a fluid for filling a container, and eject the fluid from the orifice in the form of a stream into the container. The fluid filling nozzle is further constructed to vibrate at a reference ultrasonic frequency and at a vibration amplitude when the flow of the fluid to the fluid filling nozzle is stopped. The vibration amplitude is configured to break a fluid string of the fluid extending from the orifice at the discharge end of the fluid filling nozzle.

The fluid filling nozzle filling nozzle can be configured to operate in one of several different manners. In a first case, the fluid filling nozzle filling nozzle can be configured to operate without ultrasonic vibration being applied so as not to vibrate the nozzle when the flow of fluid is being received, and then to vibrate at a reference ultrasonic frequency and at a vibration amplitude that is configured to break a fluid string of the fluid extending from the orifice at the discharge end of the fluid filling nozzle when the flow of the fluid to the fluid filling nozzle is stopped. In a second case, the fluid filling nozzle filling nozzle can be configured to operate with ultrasonic vibration applied to vibrate the nozzle at a reference ultrasonic frequency and at an amplitude when the flow of fluid is being received which remains constant and is configured to break a fluid string when the flow of the fluid to the fluid filling nozzle is stopped. In a third case, the fluid filling nozzle filling nozzle can be configured to operate with ultrasonic vibration applied to vibrate the nozzle at a reference ultrasonic frequency and at a first vibration amplitude when the flow of fluid is being received, and then to vibrate at the reference ultrasonic frequency and at a second vibration amplitude when the flow of the fluid to the fluid filling nozzle is stopped. The second vibration amplitude is higher than the first vibration amplitude and is configured to break a fluid string of the fluid extending from the orifice at the discharge end of the fluid filling nozzle.

In another embodiment, the present disclosure is directed to a method for filling a container. The method includes receiving, by a fluid filling nozzle, a flow of a fluid for filling a container. The fluid filling nozzle has a longitudinal centerline and a body that includes a discharge end and an orifice at the discharge end. The method also includes ejecting, by the fluid filling nozzle, the fluid from the orifice in the form of a stream into the container when the flow of the fluid is received by the fluid filling nozzle. The method further includes vibrating the fluid filling nozzle at a reference ultrasonic frequency and at a vibration amplitude when the flow of the fluid to the fluid filling nozzle is stopped. The vibration amplitude is configured to break a fluid string of the fluid extending from the orifice at the discharge end of the fluid filling nozzle. The method can vibrate the fluid filling nozzle in any of the three manners described above.

In yet another embodiment, the present disclosure is directed to a fluid filling apparatus for filling a container. The fluid filling apparatus includes a fluid flow control mechanism constructed to selectably control a flow of a fluid and a fluid filling nozzle in fluid communication with the fluid flow control mechanism. The fluid filling nozzle has a longitudinal centerline and a body that includes a discharge end and an orifice at the discharge end. The fluid ejects from the orifice in the form of a stream into a container when the fluid flow control mechanism allows the fluid to flow to the fluid filling nozzle. A portion of the fluid forms a fluid string extending from the orifice at the discharge end when the fluid flow control mechanism prevents the fluid from flowing to the fluid filling nozzle. The fluid filling apparatus also includes a control unit constructed to selectively generate a control signal that is configured to cause a power signal at a reference frequency when the fluid flow control mechanism prevents the fluid from flowing to the fluid filling nozzle. The fluid filling apparatus further includes an ultrasonic transducer in communication with the filling nozzle. The ultrasonic transducer is constructed to vibrate the fluid filling nozzle at the reference frequency. The ultrasonic transducer is constructed to vibrate the fluid filling nozzle at a vibration amplitude as a function of the power signal. The vibration amplitude is configured to break the fluid string extending from the orifice at the discharge end of the fluid filling nozzle. The fluid filling apparatus can be configured to vibrate the fluid filling nozzle in any of the three manners described above.

In yet another embodiment, the present disclosure is directed to a further method for filling a container. The method includes allowing, by a fluid flow control mechanism, a flow of a fluid to a fluid filling nozzle in fluid communication therewith, the fluid filling nozzle having a longitudinal centerline and a body. The body has a discharge end and an orifice at the discharge end. The method also ejecting the fluid in the form of a stream from the orifice of the fluid filling nozzle into a container. The method further includes preventing, by the fluid flow control mechanism, the fluid from flowing to the fluid filling nozzle to cause a portion of the fluid to form a fluid string extending from the orifice at the discharge end of the fluid filling nozzle. Additionally, the method includes generating, by the control unit, a control signal to cause a power signal at the reference frequency. The method further includes vibrating, by the ultrasonic transducer as a function of the power signal, the fluid filling nozzle at the reference frequency and at a vibration amplitude to break the fluid string extending from the orifice at the discharge end of the fluid filling nozzle. The method can comprise sending a control signal or signals to vibrate the fluid filling nozzle in any of the three manners described above.

DESCRIPTION OF DRAWINGS

The above-mentioned and other features and advantages of the present disclosure, and the manner of attaining them, will become more apparent and the disclosure itself will be better understood by reference to the following description of nonlimiting embodiments of the disclosure taken in conjunction with the accompanying drawings, in which like references indicate similar elements and in which.

DETAILED DESCRIPTION

Figure 1:
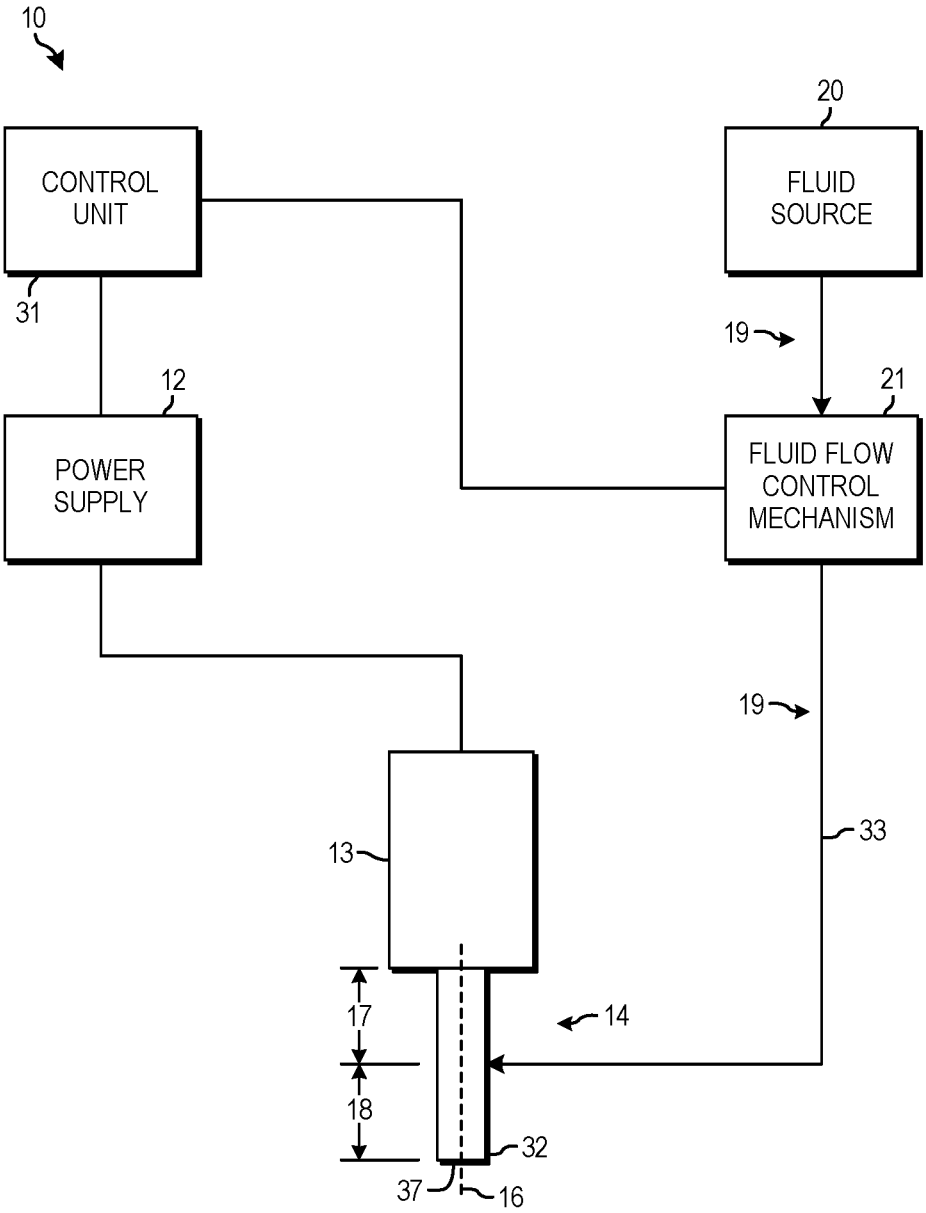
FIG. 1 is an exemplary apparatus for filling a container with a fluid.

The present disclosure provides for systems, apparatuses, and methods for filling containers with a fluid. In particular, the present disclosure relates to a fluid filling nozzle, an apparatus, and a method that utilizes ultrasonic vibration to break liquid string filaments extending from the fluid filling nozzle between successive filling cycles of containers. Various nonlimiting embodiments of the present disclosure will now be described to provide an overall understanding of the principles of the function, design and use of the fluid filling technologies disclosed herein. One or more examples of these nonlimiting embodiments are illustrated in the accompanying drawings. Those of ordinary skill in the art will understand that the apparatuses described herein and illustrated in the accompanying drawings are nonlimiting example embodiments and that the scope of the various nonlimiting embodiments of the present disclosure are defined solely by the claims. The features illustrated or described in connection with one nonlimiting embodiment can be combined with the features of other nonlimiting embodiments. Such modifications and variations are intended to be included within the scope of the present disclosure.

The term "vibration amplitude," as used herein, refers to the vibration displacement of the fluid filling nozzle tip. The displacement is measured from peak-to-peak. The term "critical vibration amplitude," as used herein, refers to the minimum amount of vibration displacement of the fluid filling nozzle tip sufficient to break a fluid string filament extending from the fluid filling nozzle.

The term "container," as used herein, includes single unit dose containers (e.g., soluble unit dose pods, pouches, bags, sachets, capsules, etc.), bottles, bags, boxes, cans, cups, vials, and/or any other type of container or packaging capable of holding a fluid or a liquid. In certain embodiments, the container is a soluble unit dose pod, such as those illustratively described in U.S. Pat. Nos. 7,125,828, 7,127,874, 8,656,689, 9,233,768, and U.S. Pat. App. Pub. No. 2009/0199877.

The term "filling", as used herein, refers to dispensing a fluid in a container to at least partially fill the container. The filling is not required to be to any particular level. In some cases, the container may be completely filled, but this is not required unless specified.

The term "fluid," as used herein, refers to a liquid, gel, slurry, or flowable paste. The term "solids" as used herein refers to particles that are not in dissolved in the fluid.

The term "stream," as used herein, refers to an unbroken flow of a fluid. The term "stream" is distinguishable from an atomized spray of minute droplets or particles of fluid.

The term "piezoelectric effect," as used herein refers to the ability of crystals and certain ceramic materials to generate a voltage in response to applied mechanical stress. The piezoelectric effect is reversible in that piezoelectric crystals, when subjected to an externally applied voltage, can change shape by a small amount. The effect finds useful applications such as the production and detection of sound. As used herein, the term "piezoelectric transducer" refers to the actuators and sensors built with the piezoelectric materials.

The term "magnetostriction," as used herein refers to a property of ferromagnetic materials that causes them to change their shape when subjected to a magnetic field. Magnetostrictive materials can convert magnetic energy into kinetic energy, or the reverse. The actuators and sensors built with the magnetostrictive materials are magnetostrictive transducers. The term "magnetostrictive transducer" as used herein refers to the actuators and sensors built with the magnetostrictive materials.

Figure 2A:
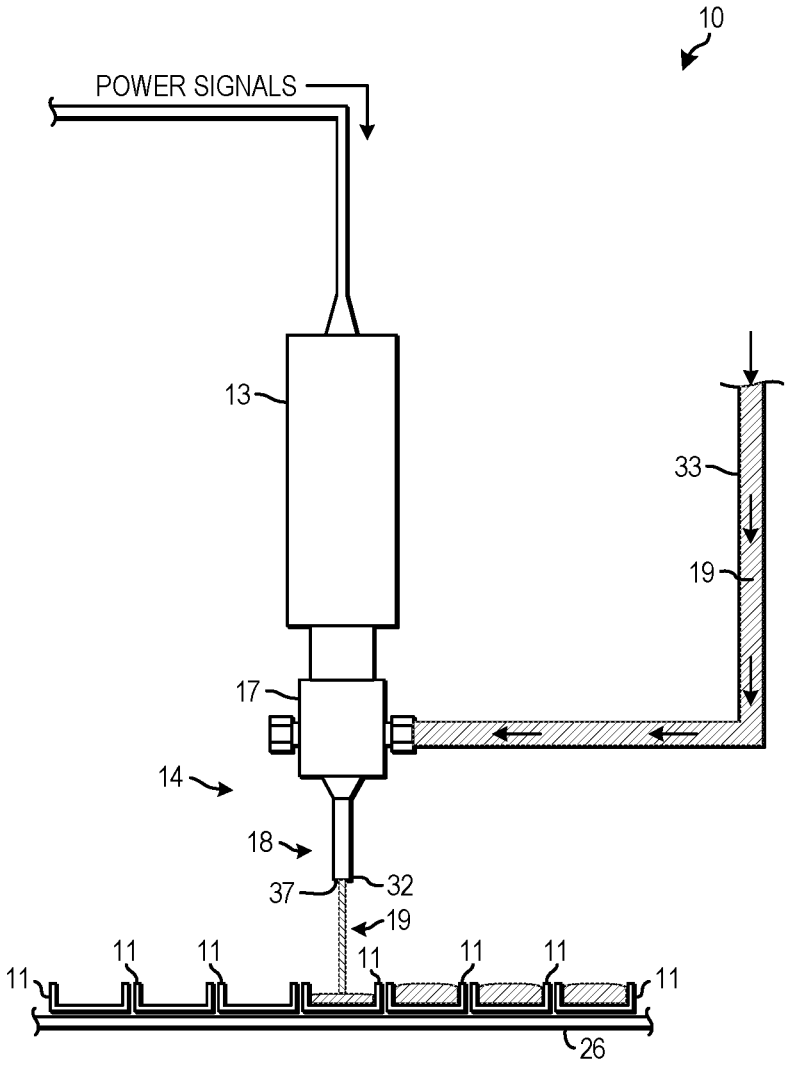
FIGS. 2A-2C schematically depict the filling of a container with a fluid by an exemplary fluid filling nozzle of FIG. 1.
Figure 2B:
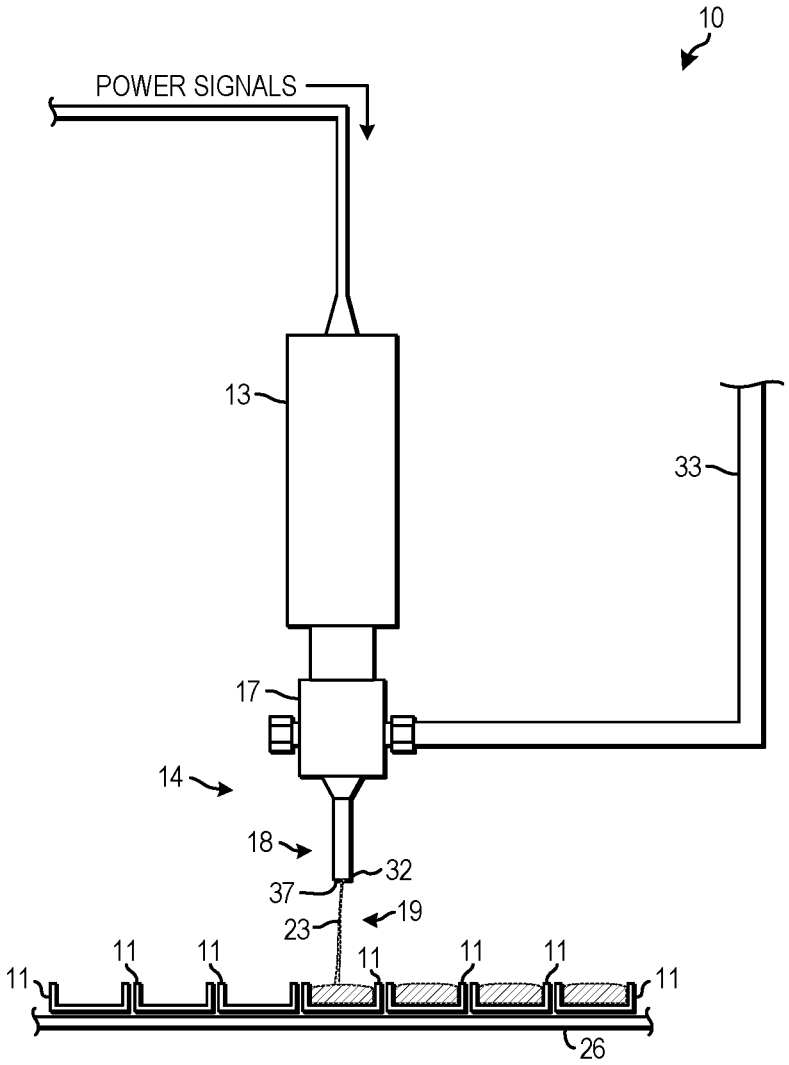
Figure 2C:
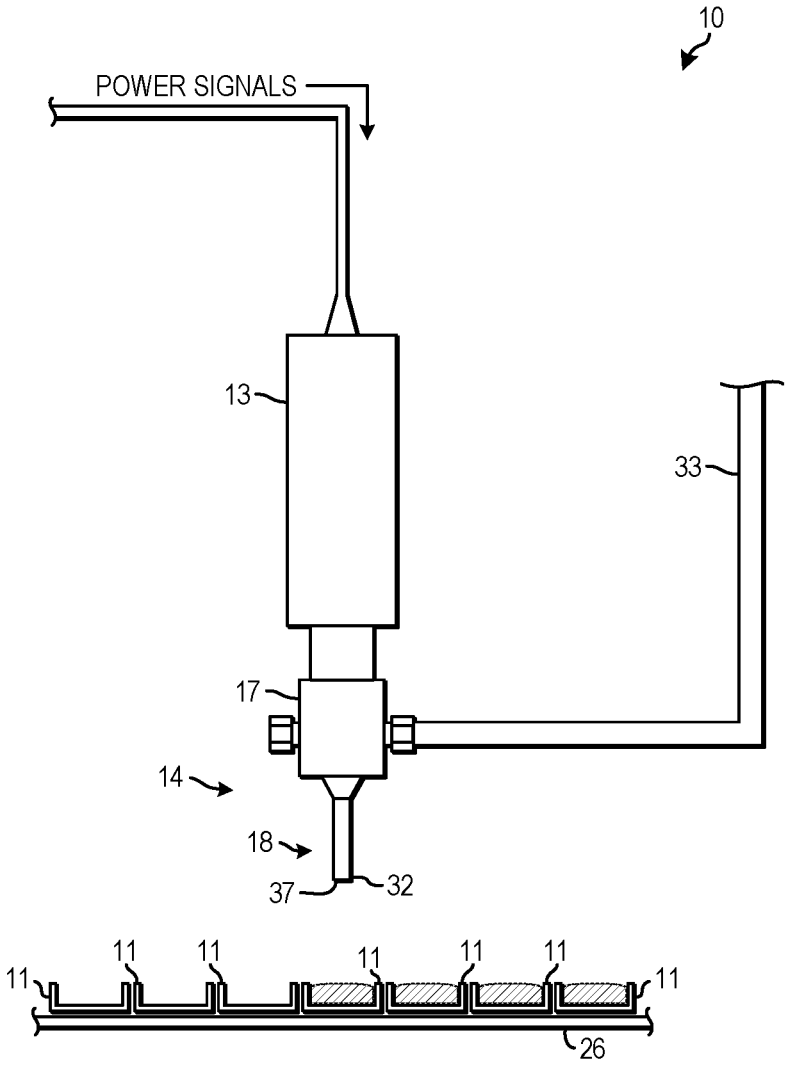

Referring now to FIG. 1, a fluid filling apparatus 10 for filling containers 11 (shown in FIGS. 2A-2C) with a fluid 19 is depicted in accordance with one nonlimiting embodiment of the present disclosure. The fluid filling apparatus 10 includes a fluid source 20, a fluid flow control mechanism 21, a control unit 31, and a fluid filling nozzle 14. In some embodiments, the fluid filling apparatus 10 also includes a power supply 12, which may form part of the control unit 31 or may be embodied as a separate and distinct component of the fluid filling apparatus 10. In operation, the fluid filling nozzle 14 is constructed to dispense or eject a fluid 19 in the form of a stream into a container 11, thereby filling the container 11 as successively shown in FIGS. 2A-2C. To do so, the fluid filling nozzle 14 receives a flow of the fluid 19 from the fluid source 20. The fluid source 20 may be a tank, vessel, or any other storage mechanism constructed to hold the fluid 19 to being dispensed. In some embodiments, the flow of the fluid 19 to the fluid filling nozzle 14 is controlled by the fluid flow control mechanism 21, which may in turn be controlled by the control unit 31. It should be appreciated that although only one fluid filling nozzle 14 is shown in the illustrative embodiments, the fluid filling apparatus 10 can include any number of fluid filling nozzles 14 in other embodiments. For example, the fluid filling apparatus 10 can include multiple fluid filling nozzles 14 (not shown) configured to fill a corresponding number of containers with the fluid 19 at substantially the same time. In such embodiments, the fluid filling nozzles 14 can be located in series and/or in parallel.

At the end of a filling cycle, the flow of the fluid 19 to the fluid filling nozzle 14 is stopped. Additionally, a direction of the flow of the fluid 19 can also be reversed. For example, in some embodiments, the flow of the fluid 19 can be reversed such that the fluid 19 flows away from the fluid filling nozzle 14 and towards the fluid source 20. It should be appreciated that although the flow of the fluid 19 to the fluid filling nozzle 14 is stopped at the end of a filling cycle in the illustrative embodiment, the rate of the flow of the fluid 19 to the fluid filling nozzle 14 can instead be reduced, in other embodiments. In any case, the stoppage, reversal, and/or the reduction of the flow of the fluid 19 to the fluid filling nozzle 14 may cause a fluid string filament 23 (shown in FIG. 2B) of the fluid 19 to form between the fluid filling nozzle 14 and the container 11 being filled. In applications in which the fluid filling apparatus 10 is utilized to successively fill containers 11, formation of the fluid string filament 23, which may also occur in-between filling cycles, increases the total amount of time needed to fill each container 11, increases the potential for a portion of the fluid 19 to be exposed to the environment, and increases the potential for a portion of the fluid 19 to be splashed or deposited onto the fluid filling apparatus 10 and/or onto the outside of the containers 11. In the case of soluble unit dose pods, formation of the fluid string filament 23 also increases the potential for a portion of the fluid 19 to be splashed or deposited onto a sealing region of the container 11 being filled, which can, in some cases, cause a leak, prevent sealing, and/or reduce the seal strength in the affected sealing region of the container 11 being filled.

After formation of the fluid string filament 23 at the end of the filling cycle, the fluid filling nozzle 14 vibrates at a reference ultrasound frequency and at a reference vibration amplitude, which are configured to break the fluid string filament 23. In doing so, the fluid filling apparatus 10 prevents the fluid 19 from being exposed to the environment, from splashing on the filling equipment, and/or from contaminating the sealing region of the container 11 being filled between filling cycles. In some embodiments, the fluid filling nozzle 14 does not vibrate during the filling cycle. In other embodiments, the fluid filling nozzle 14 vibrates at a single vibration amplitude beginning either before or during the filling cycle. In these embodiments, the single vibration amplitude may be set such that it does not significantly disturb the flow of fluid during the filling process, but is sufficient to break the string of fluid at the end of the filling cycle. In other embodiments, the fluid filling nozzle 14 vibrates at the reference ultrasound frequency and at an initial reference vibration amplitude when the fluid 19 is being ejected into the container 11 and vibrates at the reference ultrasound frequency and at a different reference vibration amplitude when the flow of the fluid 19 is stopped, reversed, or reduced to/from the fluid filling nozzle 14.

Figure 3:
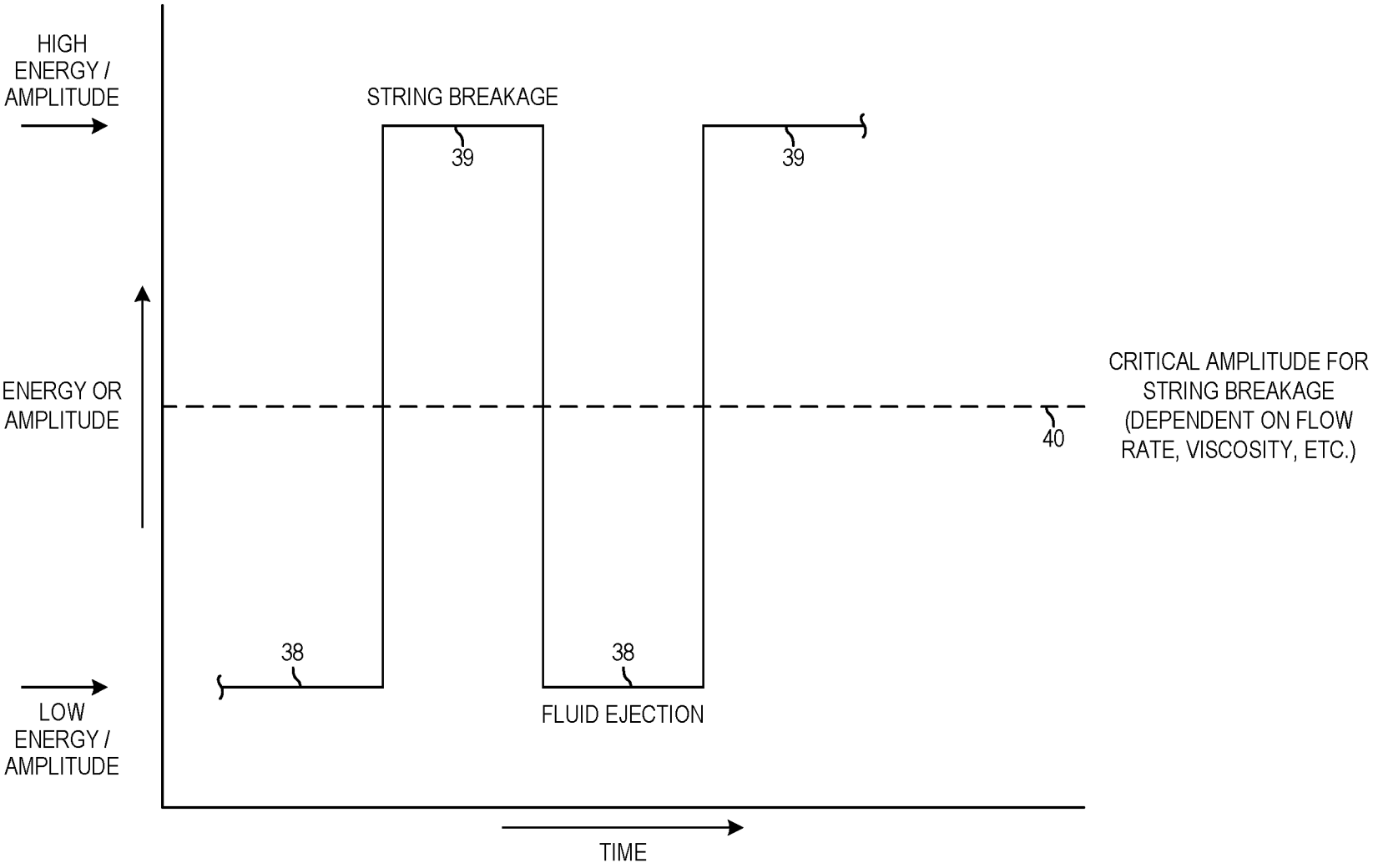
FIG. 3 is a graphical representation of one embodiment of the vibration amplitude of the fluid filling nozzle of FIG. 1 over time.

In the latter embodiments, the reference vibration amplitude utilized when the flow of the fluid 19 is stopped, reversed, or reduced to/from the fluid filling nozzle 14 is greater than the reference vibration amplitude utilized when the fluid 19 is being ejected into the container 11 by the fluid filling nozzle 14. For example, the fluid filling nozzle 14 vibrates at a low vibration amplitude 38 (shown in FIG. 3) when the fluid 19 is being ejected into the container 11 and vibrates at a high vibration amplitude 39 (shown in FIG. 3) when the flow of the fluid 19 is stopped, reversed, or reduced to/from the fluid filling nozzle 14. Vibrating at the high vibration amplitude 39 causes the fluid string filament to be broken. In some embodiments, the fluid filling nozzle 14 can vibrate at the high vibration amplitude 39 for a configurable amount of vibration time, which can be selected based on the critical amplitude 40 (shown in FIG. 3) required to break the fluid string filament. It should be appreciated that the reference ultrasound frequency, the vibration amplitudes, and/or the configurable amount of vibration time may be selected as a function of the flow rate of the fluid 19, the viscosity of the fluid 19, the speed of the conveyer 26 (shown in FIG. 2), and/or any other characteristic or parameter of the fluid 19 and/or the fluid filling apparatus 10.

The fluid filling nozzle 14 may be any type of nozzle constructed to dispense or eject the fluid 19 into one or more containers 11. In some embodiments, the fluid filling nozzle 14 is an ultrasonic nozzle. The ultrasonic nozzle may be inventive in its own right to the extent it is configured to dispense fluid in the form of a stream (as opposed to a spray). As illustratively shown in FIGS. 1 and 2A-2C, the fluid filling nozzle 14 comprises a body having a first end 17 and a second end 18 (e.g., a discharge end). The first end 17 of the fluid filling nozzle 14 may be coupled to, or is otherwise in acoustic communication with, an ultrasonic transducer 13, which as discussed in more detail below, causes the fluid filling nozzle 14 (or a portion thereof) to vibrate at a reference ultrasonic frequency and at a reference vibration amplitude sufficient to break a fluid string filament 23 of the fluid 19 extending from the fluid filling nozzle 14 at the end of a filling cycle. The second end 18 of the fluid filling nozzle 14 provides an exit for the fluid 19 whereby the fluid 19 exiting from the fluid filling nozzle 14 is dispensed into the container 11 being filled. The second end 18 includes a nozzle tip 32. The nozzle tip 32 includes an orifice 37 which is constructed to dispense the fluid 19 into the container 11 during a filling cycle. The inner diameter of the orifice 37 can be from about 2 mm to about 6 mm. In other embodiments, the inner diameter of the orifice 37 can be from about 2.8 mm to about 5 mm. In other embodiments, the inner diameter of the orifice 37 is about 5 mm.

The ultrasonic transducer 13 may be any kind of mechanism that converts electrical energy into mechanical energy. In some embodiments, the ultrasonic transducer 13 may be a piezoelectric lead zirconate titanate ("PZT") transducer. In such embodiments, the PZT transducer (i.e., the ultrasonic transducer 13) may be disc-shaped. It should be appreciated, however, that the PZT transducer or, more generally, the ultrasonic transducer 13, may have any other shape. In other embodiments, the ultrasonic transducer 13 may be a magnetostrictive transducer.

In the illustrative embodiment, the ultrasonic transducer 13 receives electrical input in the form of a power signal at a reference frequency from the power supply 12. The received power signal is converted by the ultrasonic transducer 13 into vibratory motion at a frequency that substantially matches the reference frequency of the received power signal. For example, in the illustrative embodiment, in response to receiving a power signal having a reference frequency of 40 kHz, the ultrasonic transducer 13 converts the power signal into vibratory motion at a substantially similar frequency. The reference frequency can be any frequency suitable for breaking a fluid string 23 of the fluid 19 extending from the nozzle tip 32 of the fluid filling nozzle 14. In some embodiments, the reference frequency may be selected based at least in part on, or otherwise as a function of, the flow rate of the fluid 19, the viscosity of the fluid 19, the inner diameter of the orifice 37 of the fluid filling nozzle 14, the speed of the conveyer 26 (shown in FIG. 2), and/or any other characteristic or parameter of the fluid 19 and/or a component of the fluid filling apparatus 10. In some embodiments, the reference frequency is between about 20 kHz and about 200 kHz. In other embodiments, the reference frequency is between about 20 kHz and about 100 kHz. In other embodiments, the reference frequency is about 40 kHz. A reference frequency in these ranges is, or may be, suitable for a wide range of flow rates, viscosities, orifice diameters, and conveyor speeds used to fill containers in the consumer products industries (e.g., detergent compositions for cleaning clothes, dishes, and surfaces, oral care compositions, personal care compositions including body washes, conditioners and shampoos, and the like).

As discussed, the ultrasonic transducer 13 causes the fluid filling nozzle 14 (or a portion thereof) to vibrate at the reference ultrasonic frequency. To do so, the vibratory motion generated by the ultrasonic transducer 13 is transferred to the fluid filling nozzle 14 such that the fluid filling nozzle 14 vibrates in a direction relative its longitudinal centerline 16 at the reference frequency. In one embodiment, the fluid filling nozzle 14 is constructed to vibrate in a direction substantially parallel to the longitudinal centerline 16. In another embodiment, the fluid filling nozzle 14 is constructed to vibrate in a direction substantially normal to the longitudinal centerline 16. It should be appreciated that the fluid filling nozzle 14 may be constructed to vibrate in any other direction relative to the longitudinal centerline 16, in other embodiments.

The ultrasonic transducer 13 also causes the fluid filling nozzle 14 (or a portion thereof) to vibrate at various vibration amplitudes. In some embodiments, the ultrasonic transducer 12 causes the fluid filling nozzle 14 (or a portion thereof) to vibrate the fluid filling nozzle 14 at the various vibration amplitudes. For example, in some cases when a flow of the fluid 19 is being supplied to the fluid filling nozzle 14 during a filling cycle of a container 11, the ultrasonic transducer 13 causes the fluid filling nozzle 14 to vibrate at a first vibration amplitude (e.g., the 'low' amplitude 38 of FIG. 3). The first vibration amplitude is selected to allow the received fluid 19 to be ejected in the form of a stream from the orifice 37 of the fluid filling nozzle 14 into the container 11. Additionally, at the end of the filling cycle, when the flow of the fluid 19 is stopped or reduced, and/or when the direction of the flow of the fluid 19 is reversed, the ultrasonic transducer 13 causes the fluid filling nozzle 14 to vibrate at a second vibration amplitude (e.g., the 'high' amplitude 39 of FIG. 3). The second vibration amplitude is selected to cause breakage of the fluid string filament 23, which is formed at the end of the filling cycle and extends from the nozzle tip 32 of the fluid filling nozzle 14.

The first vibration amplitude, second vibration amplitude or, more generally, the reference vibration amplitude(s), may be selected based at least in part on, or otherwise as a function of, the flow rate of the fluid 19, the viscosity of the fluid 19, the inner diameter of the orifice 37 of the fluid filling nozzle 14, the speed of the conveyer 26 (shown in FIG. 2), and/or any other characteristic or parameter of the fluid 19 and/or a component of the fluid filling apparatus 10.

It should be appreciated that although the ultrasonic transducer 13 causes the fluid filling nozzle 14 to vibrate at different vibration amplitudes as a function of the filling cycle of the container 11 (or multiple containers 11 in successive filling applications) in the illustrative embodiment, in other embodiments, the ultrasonic transducer 13 can instead cause the fluid filling nozzle 14 to vibrate at a single vibration amplitude. In a first set of embodiments, the ultrasonic transducer 13 can cause the fluid filling nozzle 14 to vibrate at a single vibration amplitude only at the end of the filling cycle. That is, the power signal supplied to the ultrasonic transducer 13 may only be supplied at the end of the filling cycle. In such first embodiments, the ultrasonic transducer 13 may not operate (e.g., generate vibratory motion) during a filling cycle (e.g., when the fluid 14 is being supplied to the fluid filling nozzle 14). In a second set of embodiments, the ultrasonic transducer 13 can cause the fluid filling nozzle 14 to vibrate at a single vibration amplitude beginning either before or during the filling cycle. In these second embodiments, the single vibration amplitude may be set such that it does not significantly disturb the flow of fluid during the filling process, but is sufficient to break the string of fluid at the end of the filling cycle.

In embodiments in which ultrasonic transducer 13 causes the fluid filling nozzle 14 to vibrate at different reference vibration amplitudes as a function of the filling cycle, the second vibration amplitude is greater than the first vibration amplitude. For example, in some embodiments, the second vibration amplitude may be between about 1.05 times and about 20 times higher or greater than the first vibration amplitude. In other embodiments, the second vibration amplitude may be between about 1.5 times and about 20 times higher or greater than the first vibration amplitude. In yet other embodiments, the second vibration amplitude may be between about 2 times and about 4 times higher or greater than the first vibration amplitude.

As discussed, the first vibration amplitude is selected to allow the received fluid 19 to be ejected from the orifice 37 of the fluid filling nozzle 14 into the container 11. In some embodiments, the first vibration amplitude is between about 0.5 microns and about 20 microns. In other embodiments, the first vibration amplitude is between about 1 micron and about 10 microns. As also discussed, the vibration amplitude (or if the nozzle is initially vibrated at a lower amplitude, the second vibration amplitude) is selected to cause breakage of the fluid string filament 23 extending from the nozzle tip 32 of the fluid filling nozzle 14. In some embodiments, the vibration amplitude (or second vibration amplitude, as the case may be) is between about 2 microns and about 80 microns. In other embodiments, the vibration amplitude (or second vibration amplitude) is between about 4 microns and about 40 microns. If the filling nozzle is vibrated at a constant vibration amplitude during filling and after the flow is stopped, the single vibration amplitude may, for example, be in a range between about 2 microns and about 20 microns.

The fluid 19 may be any type of liquid, gel, slurry, or flowable paste to be dispensed in to one or more of the containers 11. In some embodiments, the fluid 19 may be a base material (e.g., water). In other embodiments, the fluid 19 may be a formulation or a pre-mixed composition including multiple materials or ingredients. For example, the fluid 19 may include, among other materials, one or more surface active materials. The surface active materials may be one or more of sodium lauryl sulfate, polysorbate 80, non-ionic surfactant and monoglyceride, and lecithin. Additionally or alternatively, the fluid 19 may include a flavorant. It should be appreciated that the fluid 19 may, additionally or alternatively, contain other ingredients or materials based on the intended final form or composition of the fluid 19. As discussed herein, the characteristics of the fluid 19 (e.g., viscosity, solids content, rheological behavior, etc.), among other factors, may affect the critical vibration amplitude 40 and/or the high vibration amplitude 39 required to break the liquid string filament 23 formed at the end of a filling cycle (or in-between filling cycles in successive filling operations). For example, in some embodiments, the fluid 19 may be a hand dish detergent liquid having a viscosity between about 200 centipoise and about 6000 centipoise. In another embodiment, the fluid 19 may be a laundry detergent liquid having a viscosity of around 600 centipoise. As such, based at least in part on the corresponding viscosity of the liquid 19, the critical vibration amplitude 40 needed to break a liquid string filament 23 of the hand dish detergent liquid may be different than the critical vibration amplitude 40 needed to break a liquid string filament 23 of the laundry detergent liquid.

The fluid flow control mechanism 21 may be a fluid shutoff valve assembly, a poppet valve, a gear pump, or any other mechanism constructed to control the flow of the fluid 19 to/from the fluid source 20 to the fluid filling nozzle 14. The fluid flow control mechanism 21 may be in fluid communication with the fluid filling nozzle 14 via a non-clogging feed tube 33. The fluid flow control mechanism 21 may be constructed to stop or otherwise reduce the flow of the fluid 19 to the fluid filling nozzle 14. The fluid flow control mechanism 21 may also be constructed to reverse the direction of the flow of the fluid 19 such that the fluid 19 flows away from the fluid filling nozzle 14. The fluid flow control mechanism 21 may be constructed to perform such functionality based on control signals received from the control unit 31. Additionally or alternatively, in some embodiments, the fluid flow control mechanism 21 includes, or is in fluid communication with, a positive displacement pump. In such embodiments, the total flow rate of the liquid 19 is adjusted accurately by the rotational speed of the pump thereby eliminating the dependence of the flow rate on factors such as the viscosity of the fluid 19, concentration of ingredients in the fluid 19, and other characteristics of the fluid 19.

The control unit 31 may be a programmable logic controller, a programmable automation controller, a programmable logic relay, a computing device, a server, one or more programmable timers, and/or any other type of manufacturing, process, or automation control system or device. The control unit 31 is constructed to control one or more components of the fluid filling apparatus 10 based on the filling cycles of one or more containers 11. For example, in some embodiments, the control unit 31 may be configured or constructed to cause the fluid flow control mechanism 21 to enable (e.g., allow, permit, cause, etc.) a flow of the fluid 19 to be provided to the fluid filling nozzle 14 during filling cycle(s) of the container(s) 11. The control unit 31 may also be configured to cause the fluid flow control mechanism 21 to stop, reverse the direction, or reduce the rate of the flow of the fluid 19 to the fluid filling nozzle 14 at the end of the filling cycle(s) of the container(s) 11. The control unit 31 may also be configured to generate control signals that control the operation (e.g., line speed, time delays, etc.) of the conveyor 26 or related components.

As discussed, in some embodiments, the control unit 31 may include the power supply 12. In other embodiments, the power supply 12 may be a separate and distinct component of the fluid filling apparatus 10 in communication with the control unit 31. In either case, the control unit 31 may selectively generate control signals, which when received by the power supply 12, causes the power supply 12 to generate electrical output in the form of power signals at the reference frequency. For example, when a flow of the fluid 19 is being supplied to the fluid filling nozzle 14 during a filling cycle of a container 11, the control unit 31 may generate a first control signal. In turn, the power supply 12 generates a first power signal at the reference frequency as a function of the first control signal. The first power signal is then supplied to the ultrasonic transducer 13, which converts the first power signal into vibratory motion. As discussed, in some embodiments the ultrasonic transducer 13 causes the fluid filling nozzle 14 to vibrate at the reference ultrasonic frequency and at a first vibration amplitude (e.g., the low vibration amplitude 38 of FIG. 3) as a function of the supplied first power signal. Additionally, at the end of the filling cycle, when the flow of the fluid 19 is stopped or reduced, and/or when the direction of the flow of the fluid 19 is reversed, the control unit 31 may generate a second control signal. As a function of the second control signal, the power supply 12 generates a second power signal at the reference frequency. The second power signal is supplied to the ultrasonic transducer 13, which converts the second power signal into vibratory motion. As discussed, the ultrasonic transducer 13 causes the fluid filling nozzle 14 to vibrate at the reference ultrasonic frequency and at a second vibration amplitude (e.g., the high vibration amplitude 39 of FIG. 3) as a function of the supplied second power signal.

Combinations

A. A fluid filling nozzle for filling a container, the fluid filling nozzle having a longitudinal centerline and comprising:

a body having a discharge end and an orifice at the discharge end, wherein the fluid filling nozzle is constructed to (i) receive a flow of a fluid for filling a container, (ii) eject the fluid from the orifice in the form of a stream into the container when the flow of the fluid is received, and (iii) vibrate at a reference ultrasonic frequency and at a vibration amplitude when the flow of the fluid to the fluid filling nozzle is stopped, wherein the vibration amplitude is configured to break a fluid string of the fluid extending from the orifice at the discharge end of the fluid filling nozzle.

B. A method for filling a container, the method comprising:

receiving, by a fluid filling nozzle, a flow of a fluid for filling a container, wherein the fluid filling nozzle has a longitudinal centerline and a body that includes a discharge end and an orifice at the discharge end;

ejecting, by the fluid filling nozzle, the fluid from the orifice in the form of a stream into the container when the flow of the fluid is received by the fluid filling nozzle; and vibrating the fluid filling nozzle at a reference ultrasonic frequency and at a vibration amplitude when the flow of the fluid to the fluid filling nozzle is stopped, wherein the vibration amplitude is configured to break a fluid string of the fluid extending from the orifice at the discharge end of the fluid filling nozzle.

C. A fluid filling apparatus for filling a container, the fluid filling apparatus characterized in that it comprises:

a fluid flow control mechanism constructed to selectably control a flow of a fluid;

a fluid filling nozzle in fluid communication with the fluid flow control mechanism, the fluid filling nozzle having a longitudinal centerline and a body that includes a discharge end and an orifice at the discharge end, wherein the fluid ejects from the orifice in the form of a stream into a container when the fluid flow control mechanism allows the fluid to flow to the fluid filling nozzle, and wherein a portion of the fluid forms a fluid string extending from the orifice at the discharge end when the fluid flow control mechanism prevents the fluid from flowing to the fluid filling nozzle;

a control unit constructed to selectively generate a control signal configured to cause a power signal at a reference frequency when the fluid flow control mechanism prevents the fluid from flowing to the fluid filling nozzle; and an ultrasonic transducer in communication with the filling nozzle, the ultrasonic transducer is constructed to vibrate the fluid filling nozzle at the reference frequency, wherein the ultrasonic transducer is further constructed to vibrate the fluid filling nozzle at a vibration amplitude as a function of the power signal, wherein the vibration amplitude is configured to break the fluid string extending from the orifice at the discharge end of the fluid filling nozzle.

D. A fluid filling nozzle according to Paragraph A, a method according to Paragraph B, or a fluid filling apparatus of Paragraph C, wherein the fluid filling nozzle is an ultrasonic nozzle.

E. A fluid filling nozzle according to Paragraph A, a method according to Paragraph B, or a fluid filling apparatus of Paragraph C, wherein the fluid filling nozzle is constructed to operate in one of the following manners:

1. without vibrating the nozzle ultrasonically when the flow of fluid is being received, and then vibrating the nozzle at a reference ultrasonic frequency and at a vibration amplitude configured to break the fluid string extending from the orifice at the discharge end of the fluid filling nozzle when the flow of fluid to the fluid filling nozzle is stopped;
2. vibrating the nozzle ultrasonically when the flow of fluid is being received, the vibration being at a reference ultrasonic frequency and at a vibration amplitude that remains substantially constant and is configured to break the fluid string extending from the orifice at the discharge end of the fluid filling nozzle when the flow of fluid to the fluid filling nozzle is stopped;
3. vibrating the nozzle ultrasonically at a reference ultrasonic frequency and at a first ultrasonic vibration amplitude when the flow of fluid is being received, and then vibrating the nozzle at the reference ultrasonic frequency and at a second vibration amplitude, wherein the second vibration amplitude is higher than the first vibration amplitude and is configured to break the fluid string extending from the orifice at the discharge end of the fluid filling nozzle when the flow of fluid to the fluid filling nozzle is stopped F. A fluid filling nozzle according to Paragraph A, a method according to Paragraph B, or a fluid filling apparatus of Paragraph C, wherein the fluid filling nozzle is constructed to vibrate in one or both of the following directions:

a direction substantially parallel to the longitudinal centerline of the fluid filling nozzle at the reference ultrasonic frequency; and a direction substantially normal to the longitudinal centerline of the fluid filling nozzle at the reference ultrasonic frequency.

G. A fluid filling nozzle according to Paragraph A, a method according to Paragraph B, or a fluid filling apparatus of Paragraph C, wherein the reference ultrasonic frequency is between about 20 kHz and about 200 kHz, alternatively between about 20 kHz and about 100 kHz, alternatively about 40 KHz.

H. A fluid filling nozzle, a method, or a fluid filling apparatus operated in the third manner specified in Paragraph E wherein the second vibration amplitude is between about 1.05 times and about 20 times higher than the first vibration amplitude, alternatively between about 2 times and about 4 times higher than the first vibration amplitude.

I. A fluid filling nozzle according to Paragraph A, a method according to Paragraph B, or a fluid filling apparatus of Paragraph C, wherein the vibration amplitude is between about 2 microns and about 80 microns, alternatively between either about 2 microns or about 4 microns and about 40 microns, alternatively between about 2 microns and about 20 microns.

J. A fluid filling nozzle, a method, or a fluid filling apparatus operated in the third manner specified in Paragraph E, wherein the first vibration amplitude is between about 0.5 microns and about 20 microns, alternatively between about 1 micron and about 10 microns, and the second vibration amplitude is between about 2 microns and about 80 microns, alternatively between about 4 microns and about 40 microns.

K. A fluid filling nozzle according to Paragraph A, a method according to Paragraph B, or a fluid filling apparatus of Paragraph C, configured to reverse the flow of the fluid to the fluid filling nozzle.

EXAMPLES

The following are a listing of examples illustrating various embodiments of the present invention. It would be obvious to those skilled in the art that various other changes and modifications can be made without departing from the spirit and scope of the invention. In each of the illustrative examples below, a single unit dose container is filled with about 1.5 ml of a laundry detergent having a viscosity ranging between about 700 cps (@25° C.) to about 950 cps (@20° C.). In illustrative Examples 2 and 3, an ultrasound frequency of about 40 kHz is used to vibrate the fluid filling nozzle.

Example 1

| Test #1 (without ultrasound) | Time (milliseconds) |
|---|---|
| Nozzle Starts Dispensing Fluid | 0 |
| Pump Reverses | 55 |
| Stringing Breaks | 280 |
| Total Time From Dispense Start to Stringing Break | 280 |

Example 2

| Test #2 (with ultrasound) | Time (ms) | Ultrasound Amplitude (micrometer) |
|---|---|---|
| Nozzle Starts Dispensing Fluid | 0 | 0.7 |
| Pump Reverses | 60 | 0.7 |
| Ultrasound On | 120 | 3 |
| Stringing Breaks | 176 | 3 |

-continued

| Test #2 (with ultrasound) | Time (ms) | Ultrasound Amplitude (micrometer) |
|---|---|---|
| Ultrasound Off | 220 | 0.7 |
| Total Time From Dispense Start to Stringing Break | 176 | |

Example 3

| Test #3 (with ultrasound) | Time (ms) | Ultrasound Amplitude (micrometer) |
|---|---|---|
| Nozzle Starts Dispensing Fluid | 0 | 0.7 |
| Pump Reverses | 60 | 0.7 |
| Ultrasound On | 120 | 5 |
| Stringing Breaks | 170 | 5 |
| Ultrasound Off | 220 | 0.7 |
| Total Time From Dispense Start to Stringing Break | 170 | |

It should be understood that any feature and/or element of any one of the embodiments and/or examples shown and described above herein may be removed from the embodiment and/or example, replaced with a feature or element from another embodiment or example herein or replaced with an equivalent feature or element.

The dimensions and/or values disclosed herein are not to be understood as being strictly limited to the exact numerical dimensions and/or values recited. Instead, unless otherwise specified, each such dimension and/or value is intended to mean both the recited dimension and/or value and a functionally equivalent range surrounding that dimension and/or value. For example, a dimension disclosed as "40 mm" is intended to mean "about 40 mm".

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for filling a container, the method comprising:

receiving, by a fluid filling nozzle, a flow of a fluid for filling a container, wherein the fluid filling nozzle has a longitudinal centerline and a body that includes a discharge end and an orifice at the discharge end;

ejecting, by the fluid filling nozzle, the fluid from the orifice in the form of a stream into the container when the flow of the fluid is received by the fluid filling nozzle; and vibrating the fluid filling nozzle at a reference ultrasonic frequency and at a vibration amplitude when the flow of the fluid to the fluid filling nozzle is stopped, wherein the vibration amplitude is configured to break a fluid string of the fluid extending from the orifice at the discharge end of the fluid filling nozzle.

2. The method of claim 1, wherein vibrating the fluid filling nozzle comprises vibrating the fluid filling nozzle at the vibration amplitude in a direction substantially parallel to the longitudinal centerline of the fluid filling nozzle at the reference ultrasonic frequency.

3. The method of claim 1, wherein vibrating the fluid filling nozzle comprises vibrating the fluid filling nozzle at the vibration amplitude in a direction substantially normal to the longitudinal centerline of the fluid filling nozzle at the reference ultrasonic frequency.

4. The method of claim 1, wherein the fluid filling nozzle is an ultrasonic nozzle.

5. The method of claim 1, wherein the fluid filling nozzle is vibrated by the use of an ultrasonic transducer.

6. The method of claim 5, wherein the ultrasonic transducer is selected from a group consisting of a piezoelectric transducer and a magnetostrictive transducer.

7. The method of claim 1, wherein the reference ultrasonic frequency is between about 20 kHz and about 200 kHz.

8. The method of claim 1, wherein the reference ultrasonic frequency is between about 20 kHz and about 100 kHz.

9. The method of claim 1, further comprising vibrating the fluid filling nozzle at the reference ultrasonic frequency, and at a first vibration amplitude when the flow of fluid is received by the fluid filling nozzle; wherein the vibration amplitude configured to break a string of fluid extending from the orifice at the discharge end of the fluid filling nozzle when the flow of the fluid to the fluid filling nozzle is stopped comprises a second vibration amplitude, wherein the second vibration amplitude is between about 1.05 times and about 20 times higher than the first vibration amplitude.

10. The method of claim 9, wherein the first vibration amplitude is between about 0.5 micron and about 20 microns.

11. The method of claim 9, wherein the second vibration amplitude is between about 2 microns and about 80 microns.

12. The method of claim 1, further comprising reversing the flow of the fluid to the fluid filling nozzle.

13. A method for filling a container, the method comprising:

receiving, by a fluid filling nozzle, a flow of a fluid for filling a container, wherein the fluid filling nozzle has a longitudinal centerline and a body that includes a discharge end and an orifice at the discharge end;

ejecting, by the fluid filling nozzle, the fluid from the orifice in the form of a stream into the container when the flow of the fluid is received by the fluid filling nozzle; and vibrating the fluid filling nozzle at a reference ultrasonic frequency and at a vibration amplitude when the flow of the fluid to the fluid filling nozzle is stopped, wherein the vibration amplitude is configured to break a fluid string of the fluid extending from the orifice at the discharge end of the fluid filling nozzle;

wherein the reference ultrasonic frequency is between about 20 kHz and about 200 kHz, and wherein the method further comprises vibrating the fluid filling nozzle at the reference ultrasonic frequency, and at a first vibration amplitude when the flow of fluid is received by the fluid filling nozzle; wherein the vibration amplitude configured to break a string of fluid extending from the orifice at the discharge end of the fluid filling nozzle when the flow of the fluid to the fluid filling nozzle is stopped comprises a second vibration amplitude, wherein the second vibration amplitude is between about 1.05 times and about 20 times higher than the first vibration amplitude.

14. The method of claim 13, wherein the first vibration amplitude is between about 0.5 micron and about 20 microns.

15. The method of claim 13, wherein the second vibration amplitude is between about 2 microns and about 80 microns.

16. The method of claim 13, further comprising reversing the flow of the fluid to the fluid filling nozzle.

17. The method of claim 13, wherein the reference ultrasonic frequency is between about 20 kHz and about 100 kHz.

18. The method of claim 13, wherein the fluid filling nozzle is an ultrasonic nozzle.

* * * * *